US005884850A

United States Patent [19]

Norgauer

[11] Patent Number: 5,884,850

[45] Date of Patent: Mar. 23, 1999

[54] FUEL INJECTION VALVE

[75] Inventor: Rainer Norgauer, Ludwigsburg, Germany

[73] Assignee: Robert Bosch GmbH, Stuttgart, Germany

[21] Appl. No.: 884,544

[22] Filed: Jun. 27, 1997

[30] Foreign Application Priority Data

Jul. 2, 1996 [DE] Germany ..... 196 26 576.2

[51] Int. Cl.[6] ..... B05B 1/30

[52] U.S. Cl. ..... 239/585.5; 239/483; 251/129.07; 251/129.15

[58] Field of Search ..... 239/585.1, 585.4, 239/585.5, 463, 466, 472, 474, 481, 483, 487, 493; 251/129.07, 129.15

[56] References Cited

U.S. PATENT DOCUMENTS

| | | | |
|---|---|---|---|
| 4,060,199 | 11/1977 | Brune et al. | 239/585.5 X |
| 4,280,661 | 7/1981 | Tanasawa et al. | 239/585.5 X |
| 4,365,746 | 12/1982 | Tanasawa et al. | 239/585.5 X |
| 4,520,962 | 6/1985 | Momono et al. | 239/585 |
| 4,826,080 | 5/1989 | Ganser | 239/585.1 X |
| 4,982,901 | 1/1991 | Holzgrefe | 239/585.4 X |

FOREIGN PATENT DOCUMENTS

| | | |
|---|---|---|
| 25 43 805 | 4/1977 | Germany . |
| 36 24 476 | 1/1988 | Germany . |

*Primary Examiner*—Andres Kashnikow
*Assistant Examiner*—Steven J. Ganey
*Attorney, Agent, or Firm*—Kenyon & Kenyon

[57] ABSTRACT

A fuel injection valve includes at least two throttling constrictions. The fuel is guided in so that it flows through one of the throttling constrictions with a flow component directed away from the spray orifice. Thus, at least partially compensating opposing force is exerted on the valve needle or an element (e.g., an armature) with a non-positive connection to the valve needle.

10 Claims, 1 Drawing Sheet

FUEL INJECTION VALVE

FIELD OF THE INVENTION

The present invention relates to a fuel injection valve.

BACKGROUND INFORMATION

A conventional fuel injection valve is described in German Patent Application No. 36 24 476. This German Patent Application indicates that in order to improve the turbulence of the fuel in the valve needle, one or more swirl bores are provided, extending so that the bores have an axial and a tangential component with respect to a longitudinal axis of the injection valve. The fuel exiting these bores flows directly onto the valve seat face of the nozzle body. However, this conventional fuel injection valve is disadvantageous since it has a narrow opening cross section at the swirl bores, thus an unwanted force directed at the valve seat face acts on the valve needle as a result of friction, shock losses and pressure drop as the fuel flows through the swirl bores. This force (which is directed toward the valve seat face) counteracts the opening of the valve needle and can therefore cause poor valve performance.

In addition, U.S. Pat. No. 4,520,962 describes another fuel injection valve in which, instead of swirl bores, swirl grooves can be provided to improve the turbulence of the fuel because of the resulting swirl flow. With the fuel injection valve described in U.S. Pat. No. 4,520,962, however, the swirl grooves are not provided directly on the valve needle, but instead the swirl grooves are formed in a swirl element that is inserted into the nozzle body between the valve seat face and the spray orifice in the direction of flow.

German Patent Application No. 25 43 805 also describes a conventional fuel injection valve having swirl grooves on the valve needle above a feed point in the flow direction. The design of this conventional fuel injection valve includes the above-mentioned disadvantage, where an unwanted force acts on the valve needle in the closing direction due to the friction, shock losses and the pressure drop as the fuel flows through the swirl grooves, which can cause poor performance in the fuel injection valve.

SUMMARY OF THE INVENTION

The fuel injection valve according to the present invention is advantageous since the force component acting on a valve needle in the closing direction and in the area of the swirl grooves or swirl bores (which function as a first throttling constriction) is reduced, compensated or (if necessary) even overcompensated by a force component acting in the opposite direction. The fuel flows through a second throttling constriction in the opposite direction of flow. Then, a force component acts on the valve needle or on an element that has a non-positive connection to the valve needle, and counteracts the force component exerted on the valve needle by the swirl grooves or by the swirl bores. As a result of an appropriate design of the flow cross section of the second throttling constriction according to the present invention, the opposing force component can be sized so that the force component exerted on the valve needle by the fuel flow in the area of the swirl grooves or the swirl bores is reduced, compensated or (if necessary) even overcompensated. Thus, switching performance is greatly improved for the fuel injection valve according to the present invention.

The annular clearance between the armature connected to the valve needle and the housing around the armature can be advantageously used as the throttling constriction that provides compensation. This annular clearance is designed to be very narrow because of the magnetic field lines crossing the annular clearance, so that the intended throttling effect is readily achieved when the fuel flow is guided through this annular clearance with a flow component directed away from the spray orifice. Due to the fuel flow, a force component that is directed toward the opening direction of the valve needle is transmitted to the armature, and thus counteracts the force component directed toward the valve needle in the closing direction in the area of the swirl grooves or in the area of the swirl bores. It is also advantageous to implement the annular clearance between the armature and the surrounding housing as the compensating throttling constriction since it does not require any additional design or manufacturing measures. It is only necessary to direct the fuel flow through the annular clearance. Another advantage of the fuel injection valve according to the present invention is that the compensating force exerted on the armature, and thus on the valve needle, depends on the width of the annular clearance and on the diameter of the armature when the housing dimensions are given. This measurements can be varied using a manufacturing method without a high expense, so that the compensating force can be adjusted by varying the diameter of the armature.

Furthermore, axial grooves may also be provided on an outside circumference of the armature. The flow cross section can also be varied without the high manufacturing expense by appropriately adjusting the amount, width and depth of the grooves.

Additionally, the armature may include axial bores, whose amount and diameter define the flow cross section requiring compensation. This also yields a manufacturing advantage where it is readily possible to vary the compensating flow cross section by varying the amount or diameter of the axial bores.

DETAILED DESCRIPTION

Figure 1:
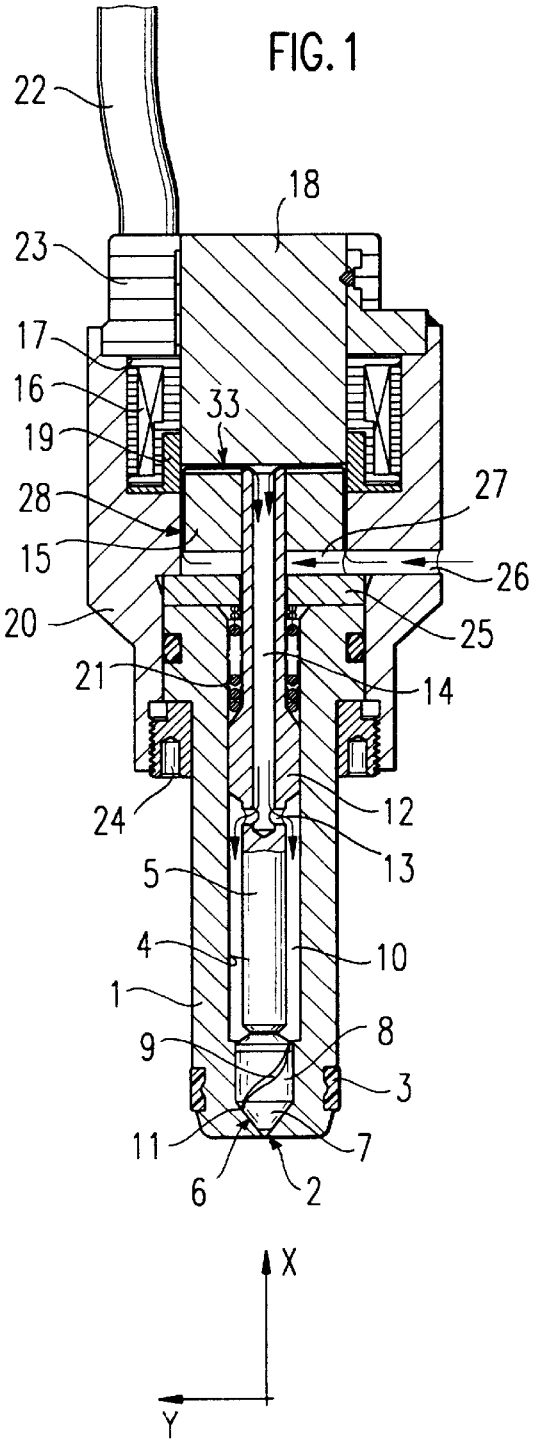
FIG. 1 shows an axial section through a first embodiment of a fuel injection valve according to the present invention.

FIG. 1 shows an electromagnetically operated valve as a first embodiment of an injection valve for fuel injection systems of internal combustion engines powered by a compressed and externally ignited fuel mixture according to the present invention. The fuel injection valve has a tubular nozzle body 1 with a spray orifice 2 can be used for direct high-pressure injection of fuel. Spray orifice 2 of the fuel injection valve (which is inserted into a cylinder of an internal combustion engine) is sealed with respect to the outside by ring gasket 3.

Nozzle body 1 has a longitudinal axial bore 4 which accommodates a valve needle 5. Upstream from spray orifice 2, a valve seat face 6 is formed on nozzle body 1 and cooperates with a truncated conical valve closing body 7 of valve needle 5 to yield a tight seating.

Upstream from valve closing body 7, valve needle 5 has a cylindrical section 8 with one or more spiral swirl grooves 9 provided on a lateral surface of the cylindrical section 8. Swirl grooves 9 are closed in the radial direction by nozzle body 1 surrounding cylindrical section 8. The swirl grooves 9 extend from a fuel chamber 10 (being within the longitudinal axial bore 4 in nozzle body 1) to a feed point 11 in the area of valve seat face 6. A swirl flow that promotes turbulence in the fuel is created with swirl grooves 9.

Due to the small cross-sectional area of swirl grooves 9, the flow of fuel through swirl grooves 9 creates an unwanted force acting against the X direction of the coordinate system (shown in FIG. 1), i.e., a force component in the closing direction of valve needle 5. This force component is caused by friction, shock losses and pressure drop generated by the fuel as it flows through swirl grooves 9. Since the force component described here counteracts the opening of valve needle 5, it can have a negative effect on valve performance.

Fuel chamber 10 is bordered on the upstream end by guide section 12 and is connected through outlet orifices 13 to a hollow axial bore 14 passing through the upper area of valve needle 5.

On the end opposite to valve closing body 7, valve needle 5 is connected to an armature 15. Armature 15 operates with a magnetic coil 16 for closing and opening the fuel valve. A coil body 17 that is stepped in the radial direction encloses the winding of magnetic coil 16. Stepped coil body 17 partially overlaps core 18, and with a step of a larger diameter it also axially overlaps intermediate part 19 at least in part. Armature 15, core 18 and housing 20 are composed of a ferromagnetic material. A closed magnetic circuit is formed by core 18, armature 15 and housing 20, where armature 15 is pulled in the direction of core 18 when magnetic coil 16 is electrically energized. This causes valve needle 5 to be raised in the X direction against the restoring force of restoring spring 21, which in turn causes the fuel injection valve to open. Restoring spring 21 is supported on supporting plate 25.

Power supply cable 22 supplies electric power to magnetic coil 16 and is connected to housing 20 by plug connection 23. Mounting elements 24 are used to assemble housing 20. When the fuel injection valve is opened, armature 15 with its armature stop face 33 strikes the face of core 18 facing spray orifice 2.

As an improvement on the first embodiment according to the present invention, the force component acting against the X direction, which is transmitted to valve needle 5 as the fuel flows through swirl grooves 9 (which act as a throttling constriction) is reduced, compensated or (if necessary) even overcompensated by a force component acting on valve needle 5 in the X direction. To obtain this result, the fuel is directed through a second throttling constriction with a flow component directed away from spray orifice 2. The opposite force component is exerted on valve needle 5 as the fuel passes through this second throttling constriction.

In the first embodiment according to the present invention, the fuel flows through a connection 26 to a fuel inlet chamber 27. The fuel flows from an area between fuel inlet chamber 27 and armature stop face 33 and through an annular clearance 28 (which is between armature 15 and surrounding housing 20). Annular clearance 28 is relatively narrow to permit loss-free crossing of the magnetic field lines between housing 20 and armature 15. Therefore, annular clearance 28 forms a second throttling constriction, so that as fuel flows through annular clearance 28, a force component is exerted on armature 15 in the X direction and thus also on valve needle 5 that is connected to armature 15. This force component counteracts the force component that is exerted on valve needle 5 opposite the X direction as fuel flows through swirl grooves 9 forming a first throttling constriction. Therefore, the force component acting on valve needle 5 in the closing direction because of the flow of fuel through swirl grooves 9 can be compensated (or at least greatly reduced) by suitable sizing the width of annular clearance 28. If necessary, it is also possible for the force acting in the closing direction to be overcompensated and thus to accelerate the opening of the fuel valve. Thus, the switching performance of the fuel injection valve is greatly improved by the fuel injection valve according to the present invention.

After flowing through annular clearance 28, the fuel flows radially in the direction of the junction of hollow bore 14 provided in valve needle 5 in the area of armature stop face 33. The fuel flows through outlet orifices 13 and hollow bore 14 (from fuel chamber 27) and then flows through swirl grooves 9 to feed point 11. The fuel is substantially prevented from flowing directly from fuel inlet chamber 27 to fuel chamber 10 (bypassing annular clearance 28) via a narrow guide clearance between guide section 12 and nozzle body 1. The compensating force can be adjusted by varying the diameter of armature 15.

Figure 2:
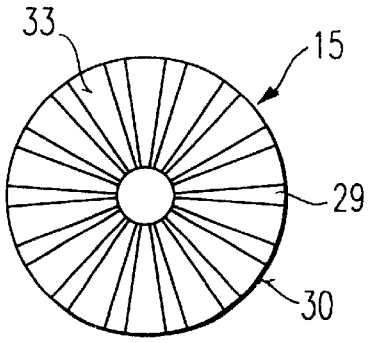
FIG. 2 shows a top view of the first embodiment of the armature of a fuel injection valve according to the present invention illustrated in FIG. 1.

FIG. 2 shows a top view of armature 15 with armature stop face 33. According to this embodiment of the present invention, radial grooves 29 may be provided on the armature stop face 33 of the armature 15 facing the core 18 to promote the flow of fuel from annular clearance 28 surrounding lateral surface 30 to central hollow bore 14 of valve needle 5 in this area.

Figure 3:
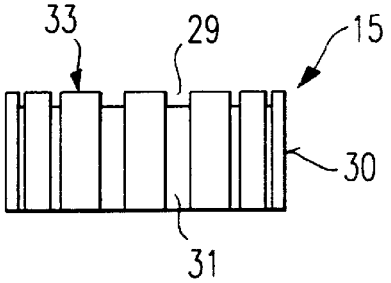
FIG. 3 shows a side view of the first embodiment of the armature of a fuel injection valve according to the present invention illustrated in FIG. 2.

FIG. 3 shows a side view of an improved armature 15 illustrated in FIG. 2. Axially aligned grooves 31 are provided on lateral surface 30. The cross-sectional area of the throttling constriction can be varied through the amount, width, and depth of grooves 31 without affecting the guide clearance between armature 15 and housing 20. Thus, the compensating force exerted on armature 15 due to the throttling constriction on lateral surface 30 can be adjusted according to the intended reduction, compensation or even overcompensation of the force component exerted on valve needle 5 at swirl grooves 9. FIG. 3 also shows radially aligned grooves 29 on armature stop face 33.

Figure 4:
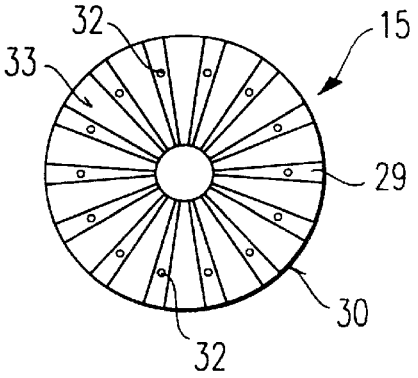
FIG. 4 shows a top view of a second embodiment of the armature of the fuel injection valve according to the present invention.

FIG. 4 shows a top view of a second embodiment of armature 15 according to the present invention. The throttling constriction here is formed by longitudinal axial bores 32, the amount and diameter of which determine the effective flow cross section.

The second compensating throttling constriction may be designed in a number of ways within the scope of the present invention. The throttling constriction may also be provided directly in the area of valve needle 5. For example, the throttling constriction may also be designed in the form of bores provided in the wall surrounding hollow bore 14 so they open into hollow bore 14 and have an axial directional component. It is important for the present invention for an area to be provided in the fuel feed where the fuel flow has a flow component directed away from spray orifice 2, with the fuel flow being throttled and force being transferred to valve needle 5 in this area. According to another embodiment of the present invention, flow forces of different types can be compensated, regardless of whether they are caused by swirl grooves, swirl bores or other throttling flow channels.

What is claimed is:

1. A fuel injection valve for a fuel injection system of an internal combustion engine, comprising:

a nozzle body including a valve seat face and at least one spray orifice situated downstream of the valve seat face;

a valve needle including a valve closing body cooperating with the valve seat face and at least one first throttling constriction allowing fuel to flow therethrough, wherein the fuel that flows through the at least one first throttling constriction has a first flow component extending toward the at least one spray orifice; and an element frictionally coupled to the valve needle, at least one of the valve needle and the element including at least one second throttling constriction for allowing the fuel to flow therethrough, wherein the fuel that flows through the at least one second throttling constriction has a second flow component extending away from the at least one spray orifice.

2. The fuel injection valve according to claim 1, wherein the fuel flowing through the at least one first throttling constriction has a first force component exerted on the valve needle in a first direction, wherein the fuel flowing through the at least one second throttling constriction has a second force component exerted on the valve needle in a second direction, the first direction being opposite to the second direction, and wherein the at least one second throttling constriction has a cross section sized so that the first force component is substantially compensated by the second force component.

3. The fuel injection valve according to claim 1, wherein the at least one first throttling constriction includes at least one of a swirl groove having a spiral pattern on an outside periphery of the valve needle and a swirl bore in the valve needle.

4. The fuel injection valve according to claim 1, wherein the element includes an armature cooperating with a magnetic coil for operating the fuel injection valve.

5. The fuel injection valve according to claim 4, further comprising:

a housing enclosing the armature and providing an annular clearance between the housing and an outside periphery of the armature, the annular clearance forming the at least one second throttling constriction for allowing the fuel to flow therethrough.

6. The fuel injection valve according to claim 4, wherein the armature includes an outer periphery having at least one groove thereon, the at least one groove forming the at least one second throttling constriction for allowing the fuel to flow therethrough.

7. The fuel injection valve according to claim 4, wherein the armature includes at least one bore forming the at least one second throttling constriction for allowing the fuel to flow therethrough.

8. The fuel injection valve according to claim 4, wherein the valve needle is coupled to the armature at a connection area, the valve needle including a hollow bore in the connection area to provide the fuel in a direction of the valve seat face.

9. The fuel injection valve according to claim 8, wherein the armature includes an armature side facing away from the valve seat face and an armature stop face provided on the armature side, and wherein the armature stop face stops a motion of the armature when the fuel injection valve is opened, the armature stop face directing the fuel to the hollow bore.

10. A fuel injection valve for a fuel injection system of an internal combustion engine, comprising:

a nozzle body including a valve seat face and at least one spray orifice situated downstream of the valve seat face;

a valve needle including a valve closing body cooperating with the valve seat face and at least one first throttling constriction allowing fuel to flow therethrough, wherein the fuel that flows through the at least one first throttling constriction has a first flow component extending toward the at least one spray orifice; and an armature cooperating with the valve needle, wherein at least one of the valve needle and the armature is positioned substantially adjacent to at least one second throttling constriction, the at least one second throttling constriction allowing the fuel to flow therethrough, wherein the fuel that flows through the at least one second throttling constriction has a second flow component extending away from the at least one spray orifice.

* * * * *